US006024295A

United States Patent [19]

Sanchez et al.

[11] Patent Number: 6,024,295

[45] Date of Patent: Feb. 15, 2000

[54] FIRE RETARDANT

[76] Inventors: John P. Sanchez, 5518 Hurricane Ct.; Jon DeLarentis, 5548 Thornberry Ct., both of Sun Valley, Nev. 89443

[21] Appl. No.: 09/049,438

[22] Filed: Mar. 26, 1998

[51] Int. Cl.[7] ..... A62C 2/06

[52] U.S. Cl. ..... 239/45; 239/43

[58] Field of Search ..... 169/43, 46, 47, 169/48

[56] References Cited

U.S. PATENT DOCUMENTS

| | | | |
|---|---|---|---|
| 3,754,601 | 8/1973 | Linkewich | 169/47 X |
| 4,076,862 | 2/1978 | Kobeski et al. | 169/45 X |
| 4,197,913 | 4/1980 | Korenowski | 169/46 X |
| 4,665,993 | 5/1987 | Balassa | 169/47 X |
| 5,132,030 | 7/1992 | Marx | 169/47 X |
| 5,509,485 | 4/1996 | Almagro | 169/46 |
| 5,849,210 | 12/1998 | Pascente et al. | 169/46 X |

*Primary Examiner*—Lesley D. Morris
*Attorney, Agent, or Firm*—Thomas M. Freiburger

[57] ABSTRACT

The invention is a method ofmaking a fire retardant and a fire retardant including seeds for replanting a fire area.

5 Claims, No Drawings

FIRE RETARDANT

BACKGROUND

Field of Invention

This invention relates generally to the field of fire retardants.

BACKGROUND OF THE INVENTION

Presently borate and water are commonly used to fight forest fires. Water is plentiful but provides no protection, as it leaches into the ground or evaporates in the heat of an on-coming blaze. Borate drops well but causes a high salt condition on the vegetation so that if the flames don't kill them, the borate probably will. The Applicants' invention uses a recycled wallboard material that is environmentally friendly.

OBJECTS OF TIE INVENTION

A first object of the invention is to provide a substance capable of being fogged or dropped from an airplane to blanket a portion of wildlands ground vegetation or structures.

A second object of the invention is a fire retardant which can resist the burning of dry brush with the material sprayed thereon.

A third object of the invention is to provide a fire retardant.

A fourth object of the invention is to provide a gypsum slurry as a pallative for dust control.

A fifth object of the invention is to provide a slurry that, when it dries, will provide erosion control.

DESCRIPTION OF PREFERRED EMBODIMENTS

Wallboard with gypsum as its primary ingredient is pulverized and water is added to form a slurry. This slurry is sprayed under pressure to act as a fire retardant. Unlike borate which quells a fire, this material can be used to form a fire break from the air or ground trucks to draw a line around the fire and contain it. This slurry can be operated with and without the wall board paper and new growth seeds can be added to begin the reseeding and growth process.

Obviously, numerous modifications and variations of the present invention are possible in light of the above teachings. It is, therefore, to be understood that within the scope of the appended claims, the invention may be practiced otherwise than as specifically described herein.

What is claimed is:

1. A method for producing a fire retardant from recycled wallboard material, comprising:

obtaining recycled wallboard material having gypsum as its primary ingredient and including paper as a part of the wallboard, pulverizing the recycled wallboard material, including the paper, and adding water to the pulverized wallboard material to form a fire retardant slurry.

2. The method of claim 1, further including the step of adding seeds to the slurry, thereby reseeding and beginning a regrowth process in an area where the fire retardant is applied.

3. A method for fighting fires using recycled materials, comprising:

obtaining wallboard having gypsum as its primary component and including paper as a component of the wallboard, pulverizing the recycled wallboard material, including the paper, adding water to the pulverized wallboard material to form a fire retardant slurry, and applying the fire retardant slurry to a ground area to form a fire break in a position to contain a fire.

4. The method of claim 3, further including the step of adding seeds to the fire retardant slurry before application of the slurry, thus reseeding and beginning a regrowth process in the area where the slurry is applied.

5. A fire retardant slurry comprising pulverized recycled wallboard, the wallboard including gypsum and paper, and water.

* * * * *